United States Patent [19]

Ringler et al.

[11] Patent Number: 4,611,411

[45] Date of Patent: Sep. 16, 1986

[54] DEVICE FOR REDUCING THE DANGER OF ACCIDENTAL DETONATION OF A LAND MINE

[76] Inventors: Shlomo Ringler, 9 Zvi Segal St., Ashkelon; Itzhak Chavet, Keren Kayemet St. 3, Rehovot, both of Israel

[21] Appl. No.: 762,890

[22] Filed: Aug. 6, 1985

[51] Int. Cl.[4] ..... A43B 3/12; A43B 7/32

[52] U.S. Cl. ..... 36/7.5; 36/7.8; 36/116; 36/1

[58] Field of Search ..... 36/7.8, 7.5, 116, 1; 272/70, 114

[56] References Cited

U.S. PATENT DOCUMENTS

| | | | |
|---|---|---|---|
| 1,266,492 | 5/1918 | Kurrell et al. | 36/7.5 |
| 2,720,714 | 10/1955 | Krohn et al. | 36/7.5 |
| 2,756,517 | 7/1956 | Youtz | 36/7.8 |
| 3,061,951 | 11/1962 | Barron | 36/7.5 |
| 3,243,898 | 4/1966 | Lewis, Jr. et al. | 36/7.5 |
| 3,516,181 | 6/1970 | Jordan | 36/7.5 |
| 4,525,941 | 7/1985 | Ruth, Jr. | 36/116 |

*Primary Examiner*—James Kee Chi

*Attorney, Agent, or Firm*—Pollock, Vande Sande and Priddy

[57] ABSTRACT

There is provided a mine-field shoe which is an inflatable multi-compartment air cushion having when inflated, at least one flexible substantially flat, ground-contacting surface, at least one rigid tread member attachable to an upper surface of the air cushion, and means for attaching the mine-field shoe to a boot. Each of the compartments of said air cushion communicates with at least one other compartment.

9 Claims, 7 Drawing Figures

DEVICE FOR REDUCING THE DANGER OF ACCIDENTAL DETONATION OF A LAND MINE

The present invention relates to a device for reducing the danger of accidental detonation of a land mine and more particularly to a mine-field shoe.

Land mines are usually detonated when a pressure, exceeding a predetemined threshold, is applied thereon. The present sensitivity to the detonation of a mine is governed, on the one hand, by the desire to provide a mine which will explode under the application of a minimal pressure and, on the other hand, a mine which will not be accidentally detonated by, e.g., the soil covering the same, or by passing, small animals.

Similar to the solution found and used by snow walker's snowshoes enabling the wearers to walk on deep snow without sinking, it has been suggested to use mine-field shoes composed of a flat, rigid surface which, as it is understood, reduces the wearer's pressure on the ground per unit area. The main disadvantages, however, of such mine-field shoes are the difficulty of movement or walking due to the rigidity of the ground contacting relatively large surface and, which is even more important, the fact that such shoes are effective only on a smooth ground. This is so since once the ground is uneven or scattered with stones, stepping thereon will no longer evenly distribute the wearer's weight across the entire tread surface but rather will concentrate said weight on the highest and limited points of contact between the ground and the shoes' surfaces. Hence this type of mine-field shoes are not sufficiently safe and of limited usefulness.

It is therefore a broad object of the present invention to ameliorate the above-described mine-field shoe and to provide a safer and more comfortable for walking mine-field shoe.

It is a further object to provide mine-field shoes which are easily transportable by being reducible in size and foldable.

In accordance with the present invention there is provided a mine-field shoe comprising an inflatable multi-compartment air cushion having when inflated at least one flexible, substantially flat, ground-contacting surface, at least one rigid thread member attachable to an upper surface of said air cushion, and means for attaching said mine-field shoe to a boot, wherein each compartment of said air cushion is adapted to communicate with at least one other compartment.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
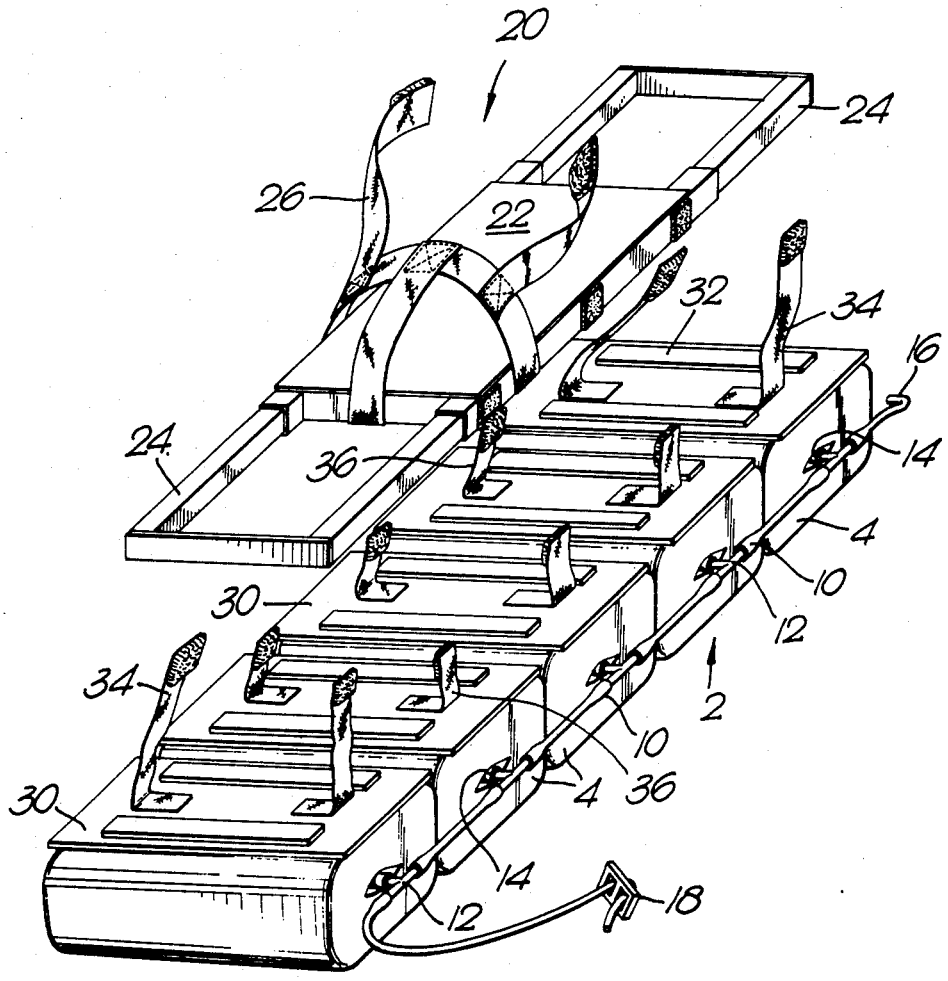
FIG. 1 is a perspective, partly exploded view of a preferred embodiment of a mine-field shoe according to the invention.
Figure 2:
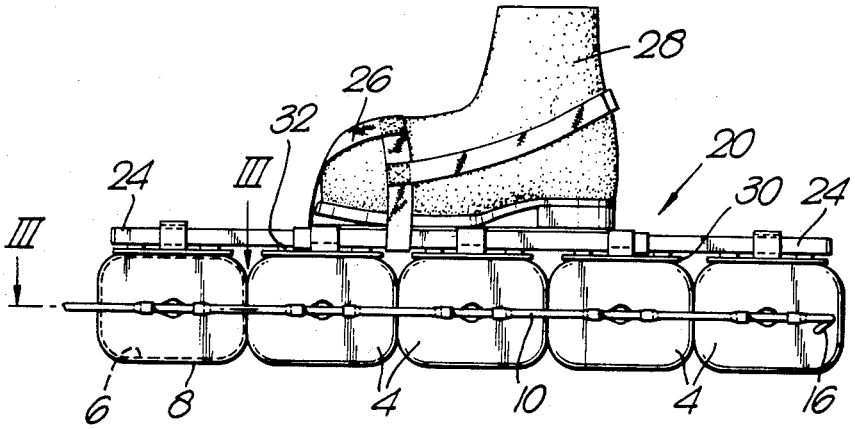
FIG. 2 is a side view of the mine-field shoe attached to a wearer's boot.
Figure 3:
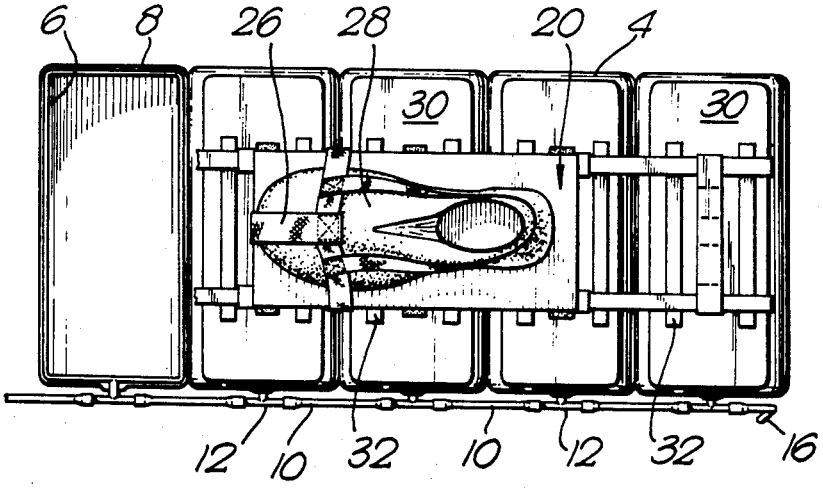
FIG. 3 is a top view and a cross sectional view along lines III—III, of FIG. 2.

Referring to the figures, there is illustrated a mine-field shoe of the foldable type, comprising an inflatable air cushion 2 composed of a plurality of chambers or compartments 4. When inflated, the compartments form an air cushion having upper and ground contacting surfaces which are substantially flat. The air cushion 2 may be made of an inner, inflatable, rubber, neoprene or the like, balloon 6 and of an outer abrasion and cut resistant fabric 8. Naturally the air cushion may otherwise be composed of an integral single layer of material which is impermeable to gas and having an outer surface which is abrasion and cut resistant. Such a layer should be capable of limiting the extent to which the compartments are inflated and of keeping their volume substantially constant below a certain maximum. As further seen in the figures, the interiors of the compartments communicate with each other by means of tubing 10 extending along the sides of the compartments 4 and suitably interconnected, e.g., with the fittings 12, to each of the compartment's inlet orifices 14. One end of the tubing 10 may be fixedly closed for example, by folding the tubing edge and clamping the same in its folded configuration as seen at 16, while the other end of the tubing is provided with a valve 18 facilitating the controlled inflation and deflation of the air cushion by the mouth, by means of a pump or by means of gas bottle.

The mine-field shoe according to the invention further comprises a rigid tread surface 20 which, in the embodiment shown, is composed of a middle box-like portion 22 and of oppositely disposed U-shaped frame members 24 arranged to be extended from, and retracted into, said box-like portion 22 so that the overall length of the tread surface is adjustable to correspond to the length of the air cushion 2. As is obvious, the function of the tread surface 20 is to evenly distribute the wearer's weight along the air cushion on top of each of the compartments 4. While the illustrated tread surface 20 is designed to facilitate compacting the mine-field shoe for carrying and transporting purposes, it should be understood that the tread surface could also be embodied by a single, rigid plate having an overall surface area substantially the same as that of the upper surface of the air cushion. The tread surface 20 is fitted with straps 26 arranged for easy attachment to a wearer's boot 28. Although the multi-compartment air cushion 2, the tubing 10 interconnecting the compartments and the tread surface 20 essentially form the mine-field shoe of the instant invention, it has been found advantageous to attach to the upper major flat surface of each compartment, a support plate 30, thus effecting an even more uniform weight distribution along the entire surface area of the air cushion. The shown support plates 30 are fitted with slots 32 and with a plurality of straps 34 and 36 having means for fixedly holding the tread surface 20 placed thereon. Such means may be of the easy to connect and release Velcro ® attachments and/or a simple buckle or clamp.

In contradistinction to the prior art mine-field shoe, in operation, when the ground contacting surface of the air cushion presses against an uneven terrain or against a protrusion, a portion or portions of said surface move inwardly, the extent of which depends, inter alia, on the air pressure prevailing inside the compartment. Since the outer skin of the compartments is deformable and the interior of the compartments are in fluid communication with each other, the increased internal pressure, caused by the decrease in volume, will instantaneously be "absorbed" by all compartments, thus effectively allowing the deformation of the ground contacting surface so as to form a matching counterpart of the terrain. This, in turn, assures that the load on the shoe will, in most cases, still be evenly distributed along the entire ground contacting surface of the air cushion.

After use, the mine-field shoe shown in the figures can be easily delfated, the tread surface detached, the telescoping arms retracted, and finally, the air cushion folded for convenient transport.

A more elaborate embodiment is shown in FIGS. 4 to 7.

Figure 4:
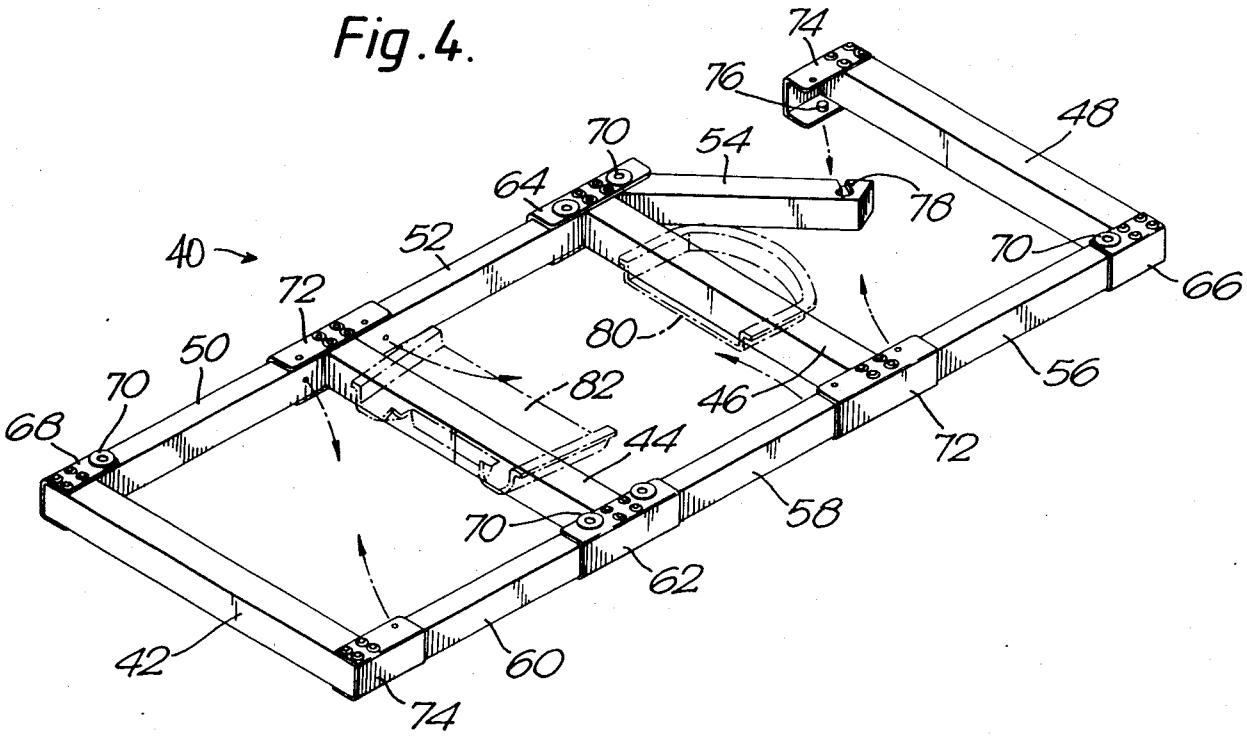
FIG. 4 is a perspective view showing the rigid tread surface of another embodiment of the invention.

In this embodiment the tread surface has the form of a frame 40 consisting of four cross members 42, 44, 46 and 48, and six lateral members 50, 52, 54, 56, 58 and 60. The latter are swivel-mounted and can be swung inwards, as shown for member 54 and indicated for the other members by the arrows. Articulation is provided by two double joints 62 and 64 and two corner joints 66, 68, all provided with hinge pins 70. As will be shown further below, this articulation is essential for collapsing the mine-field shoes when not in use. Thus lateral members 54 and 52 can be swung towards cross member 46; members 58 and 60 can be swung towards cross member 44; lateral members 56 and 50 swing towards cross members 48 and 42, respectively. The integrity of the frame 40 is maintained by locking pieces 72 and 74 into which the lateral members 50 to 60 snap with the aid of detents 76 in the locking members 72, 74 and appropriately shaped recesses 78 in the free ends of the lateral members (see member 54). Also indicated in FIG. 4 are the respective positions of the heel support 80 and a sole support 82 for the boot of the user. In a manner explained further below in conjunction with FIG. 6, these supports are fixedly attached to cross members 46 and 44, respectively.

The cross members 42 to 48 are advantageously made of extruded aluminum tubing which permits use of the convenient pop-type rivets for the permanent attachment of the joints 62 to 68 and the locking pieces 72, 74, and of the boot supports 80, 82. The lateral members 50 to 60, on the other hand are best made of aluminum diecastings. While, for the sake of simplicity, shown as solid bars, they are advantageously provided with appropriately shaped and located recesses that will save material and reduce weight without impairing strength.

Figure 5:
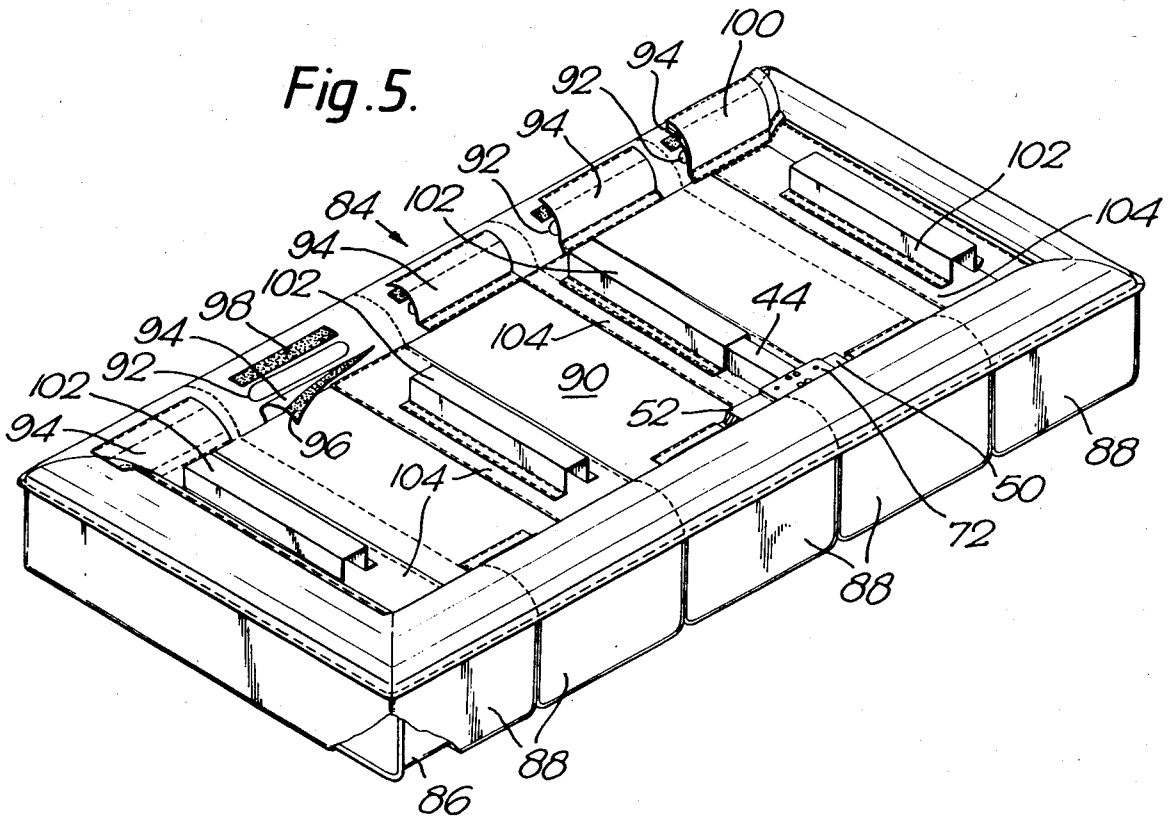
FIG. 5 is a similar view of the air cushion of this second embodiment.
Figure 7:
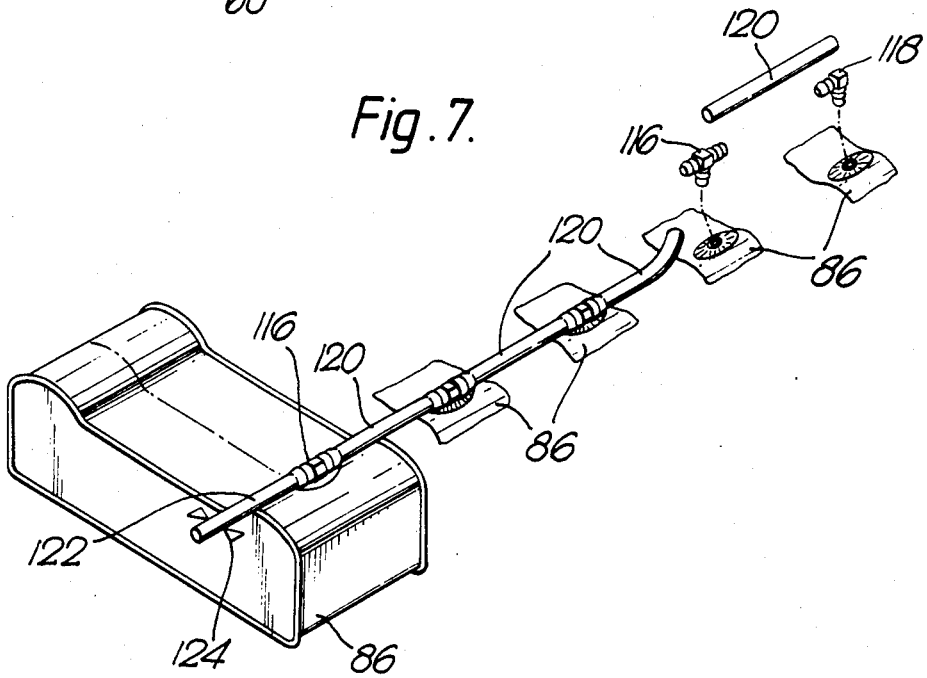
FIG. 7 shows one of the air cells of this embodiment as well as the manner in which this cell is interconnected with the other cells of the air cushion.

The air cushion 84, shown in FIG. 5, consists of five inflatable air cells 86, shown to better advantage in FIG. 7, located in pouches 88 the separate bottoms and sidewalls of which are made of a tough but very flexible material such as a nylon fabric. These pouches 88 are joined by a common top member 90 made of an equally tough, but somewhat stiffer material such as a PVC-coated cotton fabric. For each pouch 88, the top member 90 is provided with an elongated slot 92 coverable by a flap 94 provided with a strip-like Velcro ® fastener 96, the mating part 98 of which is attached to the slightly bulging rim portion of the top member 90. These slots serve for introducing the air cells 86 into the pouches 88 and for access to the connectors and tubing sections interconnecting the five air cells 86. The connectors and tube sections are seen to better advantage in FIG. 7. The last pouch 88 (at the far end) is provided with a double flap 94 and 100. The lower flap 94 closes the slot 92 as do the other flaps 94, except that the last tubing section 122 (the first one in FIG. 7), sticks out for several centimeters beyond the flap end. This is the tubing section through which the entire air cushion is inflated. After inflation and closing of the pinch cock (not explicitly shown in the drawings), this end is folded back over the lower flap 94, and covered by the upper flap 100.

Further seen on the top member 90 of the air cushion 84 are four channel-like straps 102 made of a relatively heavy nylon webbing and sewn to the top member 90 via reinforcing strips 104. It is these straps 102 that, straddling the frame cross members 42, 44, 46 and 48, join the frame 40 to the air cushion 84. For better illustration, parts of the cross member 44, the lateral members 50 and 52 as well as one locking piece 72 are shown in position. It should be noted that while in FIG. 4 the heel support 80 and the sole support 82 are shown in their position relative to the cross members 44 and 46, these supports are not directly attached to their respective cross members, but are riveted to these cross members through, and together with, the straps 102. This is seen to best advantage in FIG. 6.

Figure 6:
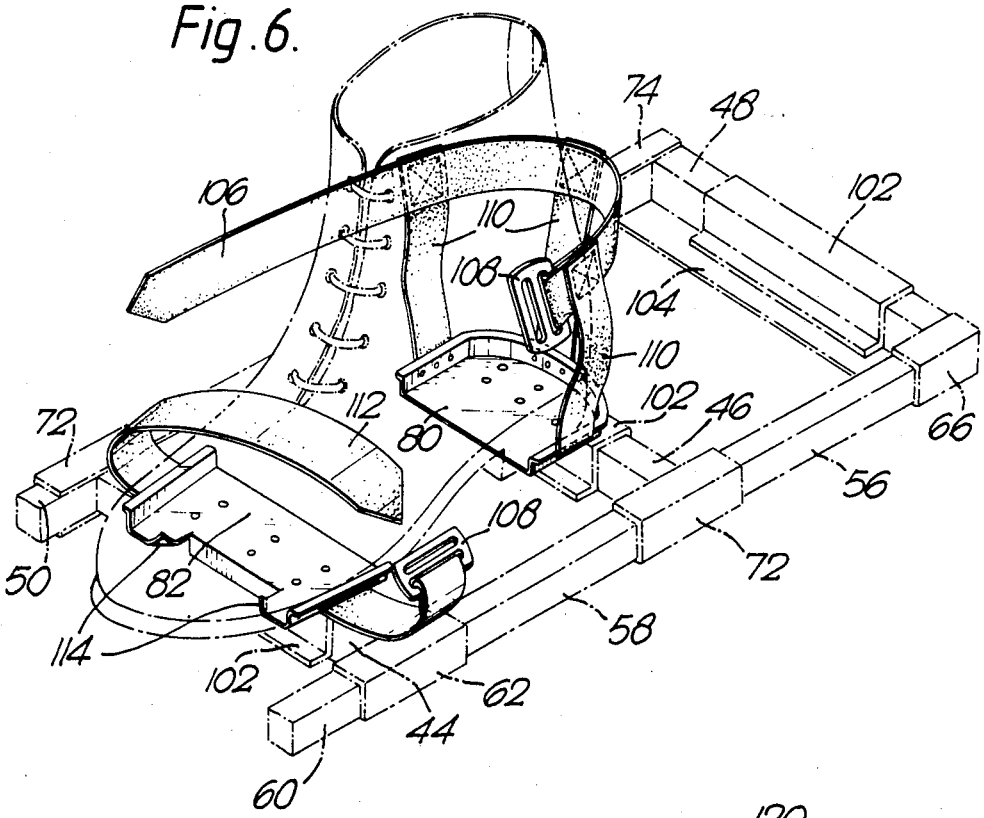
FIG. 6 is a perspective view illustrating the strapping arrangement of this embodiment.

FIG. 6 illustrates the two boot supports 80 and 82, and the manner in which the entire device is strapped to a boot. There is provided an ankle strap 106 complete with buckle 108 attached to the heel support via three auxiliary straps 110, and a toe strap 112 with buckle 108, riveted to the cross member 44 together with the sole support 82 and the cross member strap 102. After having been threaded through their respective buckles and pulled tight, the ends of straps 106 and 112 are folded back and secured by means of patches of Velcro ® fasteners not shown.

The sole support 82 is seen to be provided with two spikes 114 produced by bending upwards two sharp corners of the steel stamping from which the support is made. As the width between the two lateral guard rails of the sole support 82 is designed to accomodate the widest of soles, soles of boots of smaller sizes would be liable to slide to the left and right in spite of the toe strap 112. Such wobbling, which might interfere with the controlled "landing" of the device with each step, is eliminated by these spikes which, slightly penetrating into the sole, provide sufficient friction to prevent sideway sliding.

FIG. 7 shows apart from an air cell 86 also the T-connectors 116 in the first four cells, an L-connector 118 in the last cell, and four intermediate rubber tubing sections 120. The first tubing section 122 (already mentioned earlier) is provided with a schematically indicated pinch cock 124.

It should be remembered that all connectors and tubing sections are covered by the rim portion of the air-cushion top member 90 and its flaps 94. Defective cells 86 can be easily replaced by disconnecting their tubing section or sections, pulling out the defective cell 86 through the slot 92 (FIG. 5) and introducing, and connecting, a new cell 86.

For collapsing, the top flap 100 is opened, the tubing section 122 unfolded and the pinch cock 124 opened. The air is now let out, helped by pressure applied on the frame 40, advantageously by means of the still strapped in boot. The lateral members 50 to 60 are then all swung inward as far as they will go, after which the entire device can be rolled up into a relatively small bundle. For assembling, one proceeds as follows: The bundle is unrolled and the air cushion 84 is inflated through the protruding tubing section 122. The pinch cock 124 is closed and tucked under the flap 100. The folded lateral members 50 to 60 are now unfolded until they snap into their respective locking pieces. The boot is strapped in, and the device is ready for use.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A mine-field shoe for reducing the danger of accidental detonation of a land mine by a wearer of the shoe, comprising an inflatable multi-compartment air cushion having, when inflated, at least one flexible substantially flat ground-contacting surface that extends across a plurality of said compartments, at least one rigid tread member attachable to an upper surface of said air cushion for evenly distributing a wearer's weight along said air cushion and across the tops of said plurality of compartments, and means for attaching said mine-field shoe to a wearer's boot, each of the compartments of said air cushion being in communication with at least one other of said compartments so as to prevent any significant increase in the internal pressure of any one of said compartments resulting from a decrease in the internal volume of said one compartment, thereby to allow deformation of said ground-contacting surface to form a matching counterpart of the terrain that is engaged by said shoe while maintaining a substantially even distribution of the load on said shoe along the entire ground-contacting surface of said air cushion.

2. The mine-field shoe as claimed in claim 1 wherein said flexible ground-contacting surface is constituted by an abrasion and cut resistant fabric.

3. The mine-field shoe as claimed in claim 1, wherein at least said upper surface of said air cushion is made of a non-stretchable material.

4. The mine-field shoe as claimed in claim 1 wherein said rigid tread member comprises a pressure-distributing frame removably attachable to said upper surface of said air cushion.

5. The mine-field shoe as claimed in claim 1 wherein said rigid tread member comprises a pressure-distributing frame which is permanently attached to said upper surface of said air cushion.

6. The mine-field shoe as claimed in claim 1 further comprising a multiplicity of individual support plates interposed between the upper surface of said air cushion and said tread members.

7. The mine-field shoe as claimed in claim 4 wherein the dimensions of said pressure distributing frame are adjustable.

8. The mine-field shoe as claimed in claim 5, wherein said pressure-distributing frame is collapsible.

9. The mine-field shoe as claimed in claim 5, further comprising a boot heel support and a boot sole support attached to members of said pressure-distributing frame.

* * * * *